US011673700B2

(12) United States Patent
Brakkee et al.

(10) Patent No.: US 11,673,700 B2
(45) Date of Patent: Jun. 13, 2023

(54) DEVICE AND METHODS FOR PACKAGING MEDICAMENTS WITH FAULT DETECTION

(71) Applicant: VMI Holland B.V., Epe (NL)

(72) Inventors: Martinus Johannes Donatus Brakkee, Epe (NL); Peter van Roon, Epe (NL); Aalf Wijnia, Epe (NL); Henk Jan Spijkerboer, Epe (NL); Cornelis Jan Jochemsen, Epe (NL); Martijn Roest, Epe (NL)

(73) Assignee: VMI Holland B.V., Epe (NL)

( * ) Notice: Subject to any disclaimer, the term of this patent is extended or adjusted under 35 U.S.C. 154(b) by 62 days.

(21) Appl. No.: 17/353,948

(22) Filed: Jun. 22, 2021

(65) Prior Publication Data

US 2022/0402640 A1 Dec. 22, 2022

(51) Int. Cl.

| | |
|---|---|
| ***B65B 57/06*** | (2006.01) |
| ***B65B 9/073*** | (2012.01) |
| ***B65B 9/093*** | (2012.01) |
| ***B65B 61/00*** | (2006.01) |
| ***B65B 61/02*** | (2006.01) |
| ***B65B 61/18*** | (2006.01) |
| ***B65B 5/10*** | (2006.01) |
| ***B65B 51/30*** | (2006.01) |

(52) U.S. Cl.

CPC ..... *B65B 57/06* (2013.01); *B65B 9/073* (2013.01); *B65B 9/093* (2013.01); *B65B 61/007* (2013.01); *B65B 61/025* (2013.01); *B65B 61/18* (2013.01); *B65B 5/103* (2013.01); *B65B 51/303* (2013.01)

(58) Field of Classification Search

CPC ..... B65B 5/103; B65B 9/073; B65B 9/093; B65B 51/303; B65B 57/06; B65B 61/007; B65B 61/025; B65B 61/18; B65B 57/02; B65B 61/26; B65B 2210/04

USPC ..... 53/52, 53, 65, 131.2, 131.5

See application file for complete search history.

(56) References Cited

U.S. PATENT DOCUMENTS

| | | | | |
|---|---|---|---|---|
| 2,012,405 | A | 8/1935 | Salfisberg | |
| 2,786,566 | A | 3/1957 | Taggart et al. | |
| 3,409,721 | A | 11/1968 | Applezweig | |
| 3,591,944 | A * | 7/1971 | Wilcox | G01M 3/229 53/65 |
| 3,871,156 | A | 3/1975 | Koenig et al. | |
| 3,925,960 | A | 12/1975 | Saari | |
| 4,065,000 | A | 12/1977 | Murton | |
| 4,101,284 | A | 7/1978 | Difiglio | |

(Continued)

FOREIGN PATENT DOCUMENTS

| | | | |
|---|---|---|---|
| AU | 2016247382 | B2 | 12/2020 |
| CA | 2629632 | C | 6/2013 |

(Continued)

*Primary Examiner* — Stephen F. Gerrity

(74) *Attorney, Agent, or Firm* — N.V. Nederlandsch Octrooibureau

(57) ABSTRACT

A method for packaging discrete medicaments in pouches in a packaging device includes transporting the elongated web along a web trajectory, printing information on the elongated web related, feeding the discrete medicaments to the elongated web, inspecting the elongated web to determine whether there is a fault related to the elongated web, and in response to a fault being detected, printing a fault indication or a fault symbol on the elongated web, and forming an empty pouch at the position of the fault indication or fault symbol.

21 Claims, 6 Drawing Sheets

(56) References Cited

U.S. PATENT DOCUMENTS 4,455,810 A * 6/1984 Kreager et al. ..... B65B 57/06 53/65
4,472,922 A * 9/1984 Romagnoli ..... B65B 57/10 53/65
4,542,808 A 9/1985 Lloyd, Jr. et al.
5,219,095 A 6/1993 Shimizu et al.
5,481,855 A 1/1996 Yuyama
5,481,885 A 1/1996 Xavier et al.
5,549,217 A 8/1996 Benarrouch
5,678,393 A 10/1997 Yuyama et al.
5,839,257 A * 11/1998 Soderstrom et al. ... B65B 61/26 53/550
5,865,342 A 2/1999 Ito et al.
5,908,113 A 6/1999 Takemasa et al.
5,934,048 A 8/1999 Bouressa
6,006,946 A 12/1999 Williams et al.
6,011,998 A 1/2000 Lichti et al.
6,036,812 A 3/2000 Williams et al.
6,073,799 A 6/2000 Yuyama et al.
6,170,699 B1 1/2001 Kim
6,199,698 B1 3/2001 Hetrick et al.
6,208,911 B1 3/2001 Yamaoka et al.
6,216,418 B1 4/2001 Kim
6,367,232 B2 4/2002 Kim
6,385,943 B2 5/2002 Yuyama et al.
6,481,180 B1 11/2002 Takahashi et al.
6,508,173 B1 * 1/2003 Focke et al. ..... B65B 61/025 101/485
6,625,952 B1 9/2003 Chudy et al.
6,792,736 B1 9/2004 Takahashi et al.
7,017,623 B2 3/2006 Tribble et al.
7,182,105 B1 2/2007 Feehan et al.
7,289,879 B2 10/2007 William et al.
7,493,744 B2 2/2009 Nishimura et al.
7,637,078 B2 12/2009 Ishiwatari et al.
7,765,773 B2 * 8/2010 Nilsson et al. ..... B32B 41/00 53/65
7,784,244 B2 8/2010 Siegel
7,818,947 B2 10/2010 Kim
7,848,846 B2 12/2010 Uema et al.
7,856,794 B2 12/2010 Zieher
7,922,037 B2 4/2011 Ohmura et al.
7,950,206 B2 5/2011 Knoth
7,956,623 B2 6/2011 Bassani et al.
8,060,248 B1 11/2011 Boyer et al.
8,180,484 B2 5/2012 Baker et al.
8,186,542 B2 5/2012 Kobayashi et al.
8,220,224 B2 7/2012 Ishiwatari et al.
8,234,838 B2 8/2012 Yasunaga et al.
8,380,346 B2 2/2013 Chudy et al.
8,413,410 B2 4/2013 Ulm et al.
8,436,291 B2 5/2013 Owen et al.
8,511,478 B2 8/2013 Terzini
8,571,708 B2 10/2013 Rob et al.
8,678,197 B2 3/2014 Koike et al.
D702,273 S 4/2014 Kim
8,739,499 B2 * 6/2014 Yasunaga et al. .... B65B 61/025 53/131.5
8,950,166 B2 2/2015 Feehan et al.
9,002,510 B2 4/2015 Chudy et al.
9,037,285 B2 5/2015 Vollm et al.
D806,261 S 12/2017 Azoulay
9,839,583 B2 12/2017 Kim
9,914,554 B2 3/2018 Lokkers et al.
10,173,830 B2 1/2019 'T Lam et al.
10,219,984 B2 3/2019 Longley et al.
10,252,826 B2 4/2019 Lokkers et al.
10,457,473 B2 10/2019 Daniels
10,589,883 B2 3/2020 Van Wijngaarden et al.
2001/0001358 A1 5/2001 Yuyama et al.
2003/0226852 A1 12/2003 Kobayashi et al.
2004/0124115 A1 7/2004 Nishimura et al.
2004/0188456 A1 9/2004 Arai et al.
2005/0224511 A1 10/2005 Kim
2006/0076077 A1 4/2006 Kaplan et al.
2009/0039899 A1 2/2009 Bassani et al.
2009/0045214 A1 2/2009 Kobayashi et al.
2009/0210247 A1 8/2009 Chudy et al.
2009/0211198 A1 8/2009 McErlean et al.
2010/0018154 A1 * 1/2010 Laperche ..... B65B 57/10 53/53
2010/0050570 A1 3/2010 Mori et al.
2011/0167760 A1 * 7/2011 Spix ..... B65B 5/105 53/65
2011/0250389 A1 10/2011 Hofman et al.
2012/0159908 A1 6/2012 Hatsuno et al.
2012/0324829 A1 12/2012 Omura et al.
2013/0270291 A1 10/2013 Omura et al.
2014/0318086 A1 10/2014 Ishizuka
2014/0366489 A1 12/2014 Scholten et al.
2015/0101282 A1 * 4/2015 Yamamoto ..... B65B 9/093 53/548
2015/0239585 A1 8/2015 Weigel et al.
2015/0266604 A1 * 9/2015 Amano et al. ..... B65B 61/26 242/534
2016/0151244 A1 6/2016 Hellenbrand
2018/0290775 A1 10/2018 Gross
2019/0185193 A1 * 6/2019 Iwasaki et al. ..... B65B 61/025
2020/0402632 A1 12/2020 Van Schelven et al.

FOREIGN PATENT DOCUMENTS

DE 102010028568 A1 11/2011
EP 714651 A1 6/1996
EP 761197 B1 7/2001
EP 1114634 A2 7/2001
EP 760234 B1 11/2001
EP 1167248 A1 1/2002
EP 714651 B1 2/2003
EP 1477403 A 11/2004
EP 1477403 A1 11/2004
EP 1776275 B1 3/2009
EP 2098453 A1 9/2009
EP 2135595 A1 12/2009
EP 2168879 A2 3/2010
EP 2450855 A2 5/2012
EP 2450855 A3 5/2012
EP 2450856 A2 5/2012
EP 2450856 A3 5/2012
EP 2450857 A2 5/2012
EP 2450857 A3 5/2012
EP 001349419-0001 A1 12/2012
EP 2093722 B1 5/2013
EP 2082718 B1 7/2013
EP 2098453 B1 7/2013
EP 2168879 A3 7/2015
EP 001453104-0001 A1 12/2016
JP H03162204 A 7/1991
JP H0472115 A 3/1992
JP 05112335 A * 5/1993
JP H05132007 A 5/1993
JP H08301301 A 11/1996
JP H0956784 A 3/1997
JP H09142401 A 6/1997
JP 2798689 B2 9/1998
JP 3895989 B2 8/2001
JP 2002291845 A 10/2002
JP 2002347702 A 12/2002
JP 2003000677 A 1/2003
JP 2003512088 A 4/2003
JP 2003516279 A 5/2003
JP 2004051230 A 2/2004
JP 2005075401 A * 3/2005 ..... B65B 41/16
JP 2006204495 A 8/2006
JP 3933333 B2 6/2007
JP 4097760 B2 6/2008
JP 4338371 B2 10/2009
JP 2010195415 A 9/2010
JP 2010260619 A 11/2010
JP 2012188126 A 10/2012
JP 2013163535 A * 8/2013
JP 2016504241 A 5/2014

(56) References Cited

FOREIGN PATENT DOCUMENTS

| | | | |
|---|---|---|---|
| JP | 2014113524 | A | 6/2014 |
| KR | 20040055585 | A | 6/2004 |
| KR | 20040099106 | A | 11/2004 |
| KR | 20050117426 | A | 12/2005 |
| KR | 20100036947 | A | 4/2010 |
| WO | 9404415 | A1 | 3/1994 |
| WO | 2007092093 | A2 | 8/2007 |
| WO | 2012070643 | A1 | 5/2012 |
| WO | 2014051281 | A1 | 4/2014 |
| WO | 2014206803 | A1 | 12/2014 |
| WO | 2015068973 | A1 | 5/2015 |
| WO | 2017063791 | A1 | 4/2017 |
| WO | 2018068798 | A1 | 4/2018 |
| WO | 2018184795 | A1 | 10/2018 |
| WO | 2019170685 | A1 | 9/2019 |
| WO | 2019195629 | A1 | 10/2019 |

* cited by examiner

DEVICE AND METHODS FOR PACKAGING MEDICAMENTS WITH FAULT DETECTION

BACKGROUND

The invention relates to a packaging device for packaging discrete medicaments in pouches. Such packaging devices are typically used for packaging large amounts of pouches with a small selection of discrete medicaments, each to be administered at once to a patient.

The filled pouches are interconnected to form a long string. The state of the art packaging devices are very reliable in producing the large amounts of pouches at a high speed, whereby in practice one human operator can process many orders each having one or multiple interconnected pouches that are separated from the long string.

SUMMARY OF THE INVENTION

A disadvantage of the known packaging device is that when errors are detected by the packaging device that may affect the quality or the pharmaceutical content of the pouches, the operator needs to be warned to start an intervention. During the intervention the faulty pouches need to be traced back and discarded, which is very labor intensive. When there are small orders between large orders, there is a risk that the human operator misses it and that the small order erroneously remains attached to a large order.

It is an object of the present invention to provide a packaging device for packaging discrete medicaments in pouches, in which a human intervention can be performed effectively and efficiently.

It is an object of the present invention to provide a packaging device that facilitates the human handling of both small orders and large orders.

The invention provides a method for packaging discrete medicaments in pouches in a packaging device configured to form and fill the pouches in an elongated web, the method comprising the following steps:

transporting the elongated web along a web trajectory, printing information on the elongated web related to the discrete medicaments that are fed to the elongated web at the position of the printed information on the elongated web, feeding the discrete medicaments to the elongated web at the position on the elongated web of the related printed information, inspecting the elongated web to determine whether there is a fault related to the elongated web, and in response to a fault being detected, printing a fault indication or a fault symbol on the elongated web, and forming an empty pouch at the position of the fault indication or fault symbol.

When according to the method of the invention the elongated web is formed that is subsequently handled by an operator, the operator immediately sees from the fault indication or the fault symbol on an empty pouch that a faulty pouch is present. The operator can immediately trace back the faulty pouch and discard it, for example by counting forwards from the fault indication or the fault symbol.

In an embodiment the fault is a faulty pouch, and the printing of the fault indication or a fault symbol on the elongated web is performed upstream from the detected faulty pouch.

In an embodiment the transporting of the elongated web along the web trajectory is done by means of a web drive.

In an embodiment the printing information on the elongated web is done by means of a printer at a print station.

In an embodiment the packaging device comprises a transport monitoring device for monitoring the transport of the elongated web along the web trajectory for the step of inspecting the elongated web to determine whether there is a fault related to an alignment of the elongated web.

In an embodiment the packaging device comprises an inspection station along the web trajectory for the step of inspecting the elongated web to determine whether there is a fault related to the elongated web.

In an embodiment the inspection station comprises one or more of an inspection camera, an inspection sensor, an inspection photo sensor, an inspection laser photo sensor, or an ultrasonic inspection sensor, and the inspecting comprises an inspection of the elongated web by said inspection camera, inspection sensor, inspection photo sensor, inspection laser photo sensor or an ultrasonic inspection sensor.

In an embodiment the method further comprises applying a heat sealing in the elongated web to enclose the medicaments that have been fed to the elongated web.

In an embodiment the step of inspecting the elongated web to determine whether there is a fault related to the elongated web comprises sensing a faulty heat sealing.

In an embodiment the method further comprises applying a separation perforation line in the elongated web between pouches to be formed, and wherein the step of inspecting the elongated web to determine whether there is a fault related to the elongated web comprises detecting a faulty separation perforation line.

In an embodiment the method further comprises forming a tear notch, and wherein the step of inspecting the elongated web to determine whether there is a fault related to the elongated web comprises detecting a faulty tear notch.

In an embodiment the elongated web comprises a foil that forms a front side and a back side between which the medicaments are received.

In an embodiment thereof the foil is folded back onto itself, whereby the front side continues into the back side via a fold that forms a bottom edge of the elongated web.

In an embodiment the foil comprises a printable plastic.

In an embodiment the step of printing a fault indication or a fault symbol on the elongated web comprises printing the fault indication or fault symbol on the elongated web upstream from the fault.

The invention further provides a computer program product having a non-transitory computer readable medium with instructions saved thereon that, when executed by a processor, cause a packaging device to perform the method according to the invention.

The invention further provides a packaging device for packaging discrete medicaments in pouches, the packaging device comprising:

a web drive for transport of the elongated web in a transport direction over a web trajectory, a printing station for printing information on the elongated web, the information related to the discrete medicaments that are fed to the elongated web at the position of the printed information on the elongated web, and a filling station configured to feed the discrete medicaments to the elongated web in pouches formed in the elongated web, an inspection station for detecting a fault in the elongated web; and a controller to instruct the printing station to print a fault indication on the elongated web in response to a fault being detected in the elongated web.

In an embodiment the fault is one or more of: a faulty pouch, a faulty seal, a faulty separation perforation, a faulty tear notch and a misalignment of the elongated web with respect to one of the stations.

In an embodiment the inspection station comprises one or more of an inspection camera, an inspection sensor, an inspection photo sensor, an inspection laser photo sensor, or an ultrasonic inspection sensor.

In an embodiment the packaging device further comprises a perforation station along the web trajectory to apply one or more separation perforation and/or tear lines in the elongated web.

In an embodiment thereof the packaging device further comprises a sealing station for sealing the pouches in the elongated web.

A second aspect provides a method for packaging discrete medicaments in pouches in a packaging device, wherein the packaging device is configured to form and fill the pouches in an elongated web to contain the medicaments, wherein the packaging device comprises a web drive for transport of the elongated web in a transport direction over a web trajectory, and along the web trajectory in the transport direction a printing station and a filling station, wherein the printing station comprises a printer for printing information on the elongated web, and wherein the filling station is configured to feed the discrete medicaments to the elongated web, wherein the method comprises the following steps:

transporting the elongated web along the web trajectory in the transport direction by means of the web drive whereby the elongated web passes the printing station and the filling station, printing information on the elongated web by means of the printer, wherein the printed information on the elongated web is related to the discrete medicaments that are subsequently fed to the elongated web at the position of the printed information on the elongated web, and feeding the discrete medicaments to the elongated web at the filling station at the position of the related printed information, wherein a minimal order size of pouches is set, wherein for an order having a first amount of pouches to be filled with discrete medicaments that is lower than the minimal order size, for the pouches to be filled the information is printed that is related to the discrete medicaments that is subsequently fed to the elongated web at the position of the printed information on the elongated web, followed by a second amount of empty pouches in the elongated web, wherein the sum of the first amount and the second amount are equal to the minimal order size.

In the method according to the invention an order with is smaller than the minimal order size can easily be identified by the second amount of empty pouches.

In an embodiment the printer prints information on the empty pouches that is related to the empty status of the empty pouches.

The invention further provides a computer program product having a non-transitory computer readable medium with instructions saved thereon that, when executed by a processor, cause a packaging device to perform the method according to the second aspect.

The invention further provides a packaging device for packaging discrete medicaments in pouches, wherein the packaging device is configured to form and fill the pouches in an elongated web to contain the medicaments, wherein the packaging device comprises a web drive for transport of the elongated web in a transport direction over a web trajectory, and along the web trajectory in the transport direction a printing station and a filling station, wherein the printing station comprises a printer for printing information on the elongated web, and wherein the filling station is configured to feed the discrete medicaments to the elongated web, wherein the packaging device further comprises an electronic controller for controlling the packaging device, wherein the electronic controller comprises a processor and a non-transitory computer-readable medium holding instructions that, when executed by the processor, cause the packaging device to package discrete medicaments in pouches in accordance with the steps of the method according to the second aspect.

The various aspects and features described and shown in the specification can be applied, individually, wherever possible. These individual aspects, in particular the aspects and features described in the attached dependent claims, can be made subject of divisional patent applications.

DETAILED DESCRIPTION OF THE INVENTION

Figure 1:
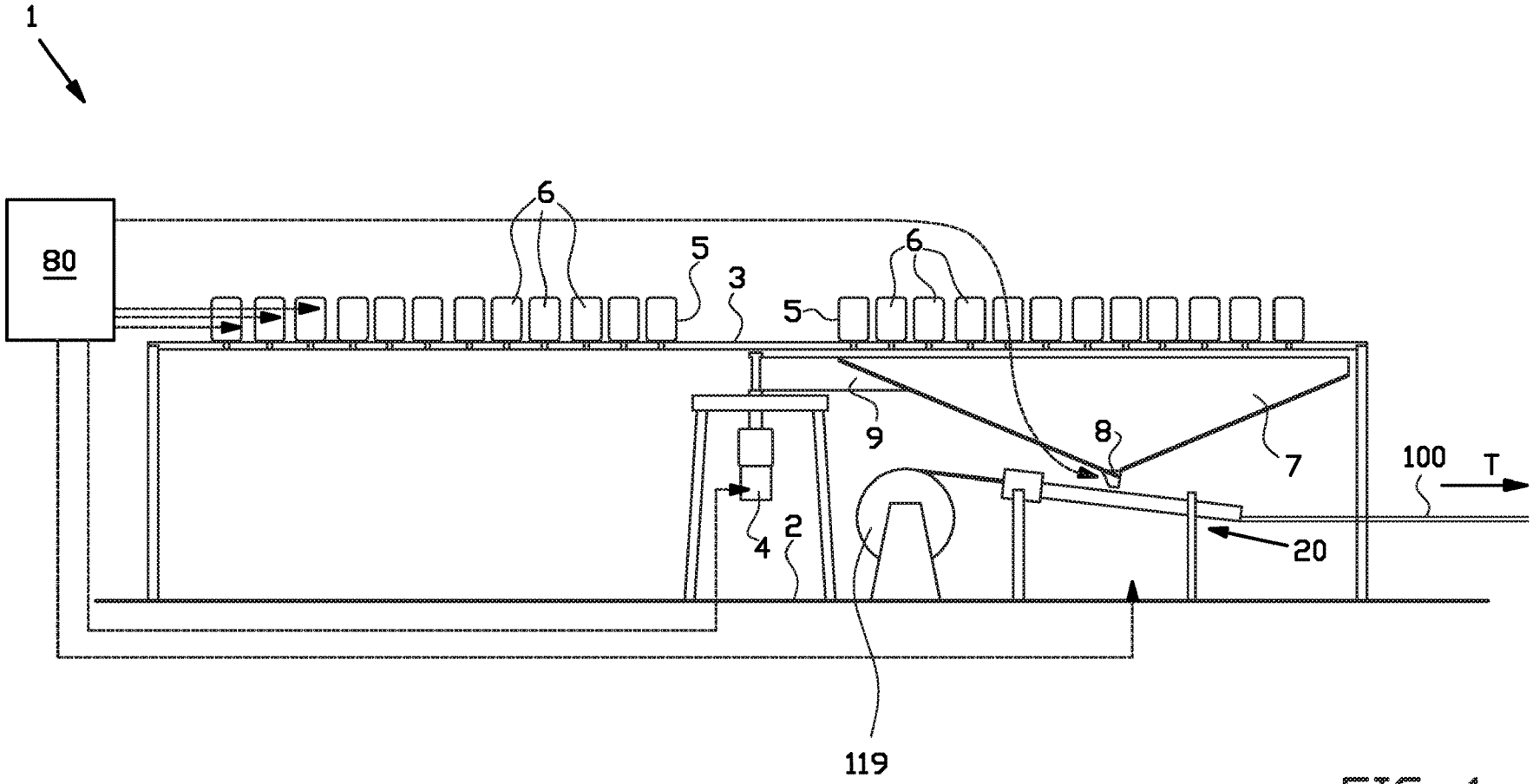
FIG. 1 is a cross sectional view of a feeder device and a packaging device for discrete medicaments according to an embodiment.

FIG. 1 shows a feeder device 1 and a packaging device 20 for discrete medicaments 10. The discrete medicaments may be pharmaceuticals or solid items, articles or substances for medical use, e.g. pills, tablets, capsules or the like. The medicaments are 'discrete' in the sense that they can be dispensed one-by-one, individually, separately or in dose units. The discrete medicaments 10 each typically comprise an active pharmaceutical ingredient (API) and optionally an excipient. The discrete medicaments can be counted and administered individually to a patient. While the system refers to and discusses medicaments, the system and method could be applicable to other consumables (edible or non-edible) that are discretely packaged.

The feeding device 1 comprises a frame 2 and a horizontally extending supporting disc 3 that supports multiple radially extending arrays 5 each having multiple canisters or feeder units 6. The feeding device 1 comprises an elongated collecting hopper 7 under the supporting disc 3 that is connected to a position control motor 4, such as a servo drive, on the frame 2 via a radially extending arm 9 to be rotated around a vertical axis. Each of the feeder units 6 can be filled with batches of different discrete medicaments. The feeder units 6 are configured to discharge individual discrete medicaments, which are collected by the collecting hopper 7 that is rotated under the discharging feeder unit 6 by means of the position control motor 4. In this manner a selection of discrete medicaments 10 is counted out and compiled to be administered to a patient at once. The collecting hopper 7 merges into a hopper outlet 8 to supply the selection of discrete medicaments 10 to a packaging device 20 for packing each of the compiled selection of discrete medicaments 10 in pouches 150. The collecting hopper 7 comprises a (not shown) hopper release valve with an actuator at the hopper outlet 8 for controlled release of the compiled selection of discrete medicaments 10.

Figure 2:
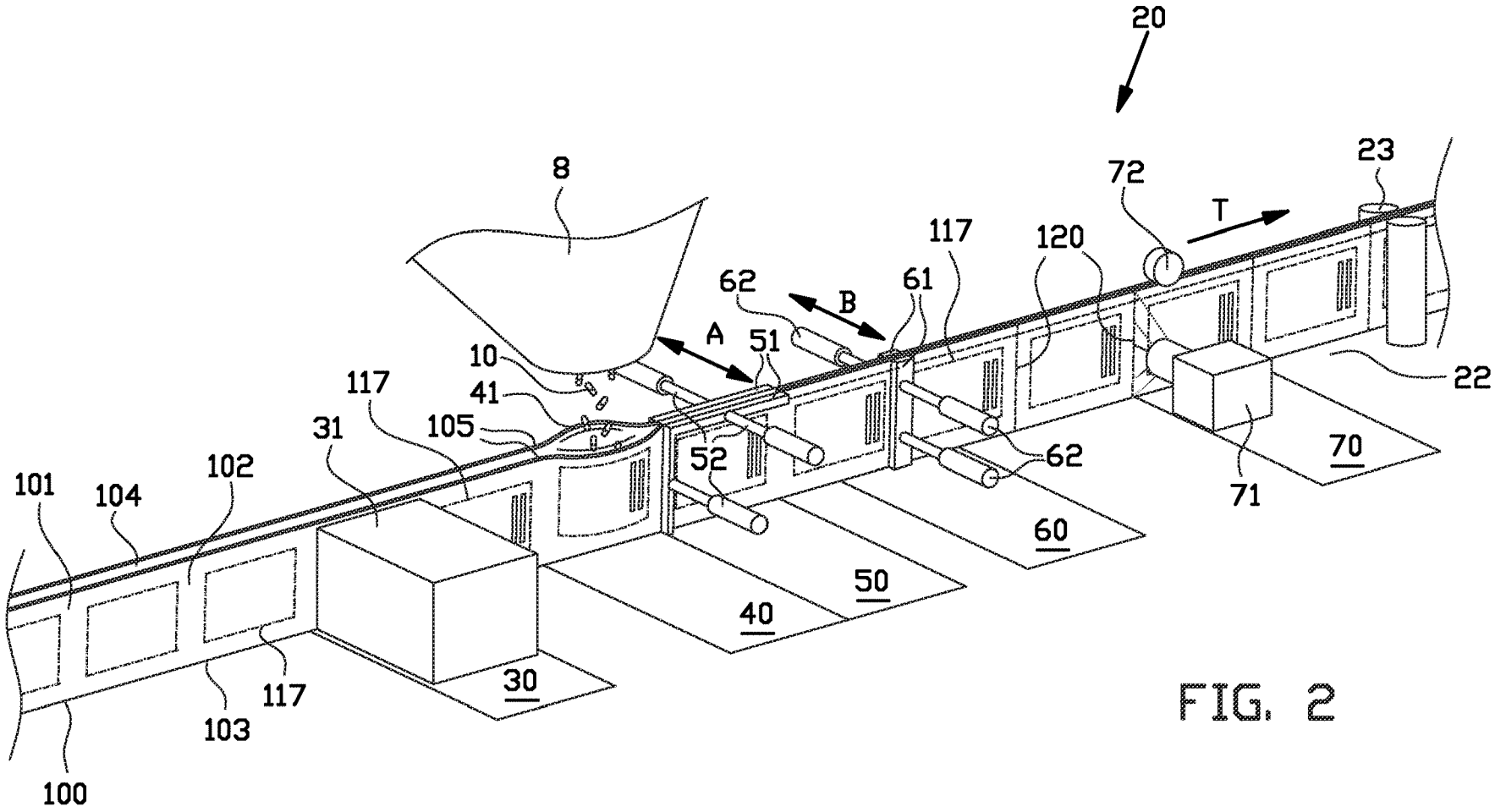
FIG. 2 is a schematic isometric view of the packaging device of FIG. 1 for filling pouches with the discrete medicaments.

The packaging device 20 is shown in more detail in FIG. 2. The packaging device 20 is configured to form and fill pouches 150 in an elongated web 100. The packaging device 20 comprises a web drive 23 for intermittent transport of the elongated web 100 in a transport direction T through the packaging device 20 over a web trajectory 22 of the packaging device 20. The elongated web 100 is typically rolled off a stock reel 119. The elongated web 100 is also shown in FIGS. 3A and 3B.

The elongated web 100 comprises a printable, plastic foil 101 that is folded back onto itself, whereby the elongated web 100 comprises a front side 102 that continues into a back side 104 via a fold that forms a bottom edge 103. The front side 102 and the back side 103 both have a top edge 105 at the same height with respect to the bottom edge 103.

Figure 3A:
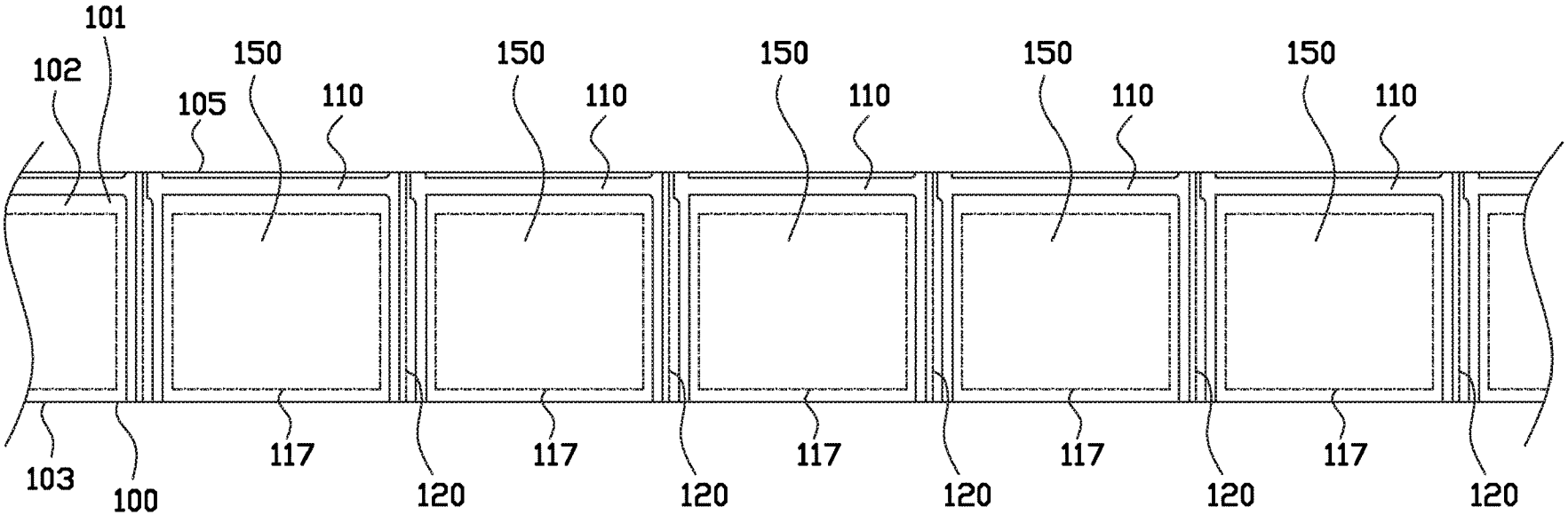
FIG. 3A is a side view of an elongated web in which the pouches are formed in the packaging device as shown in FIG. 2.
Figure 3B:
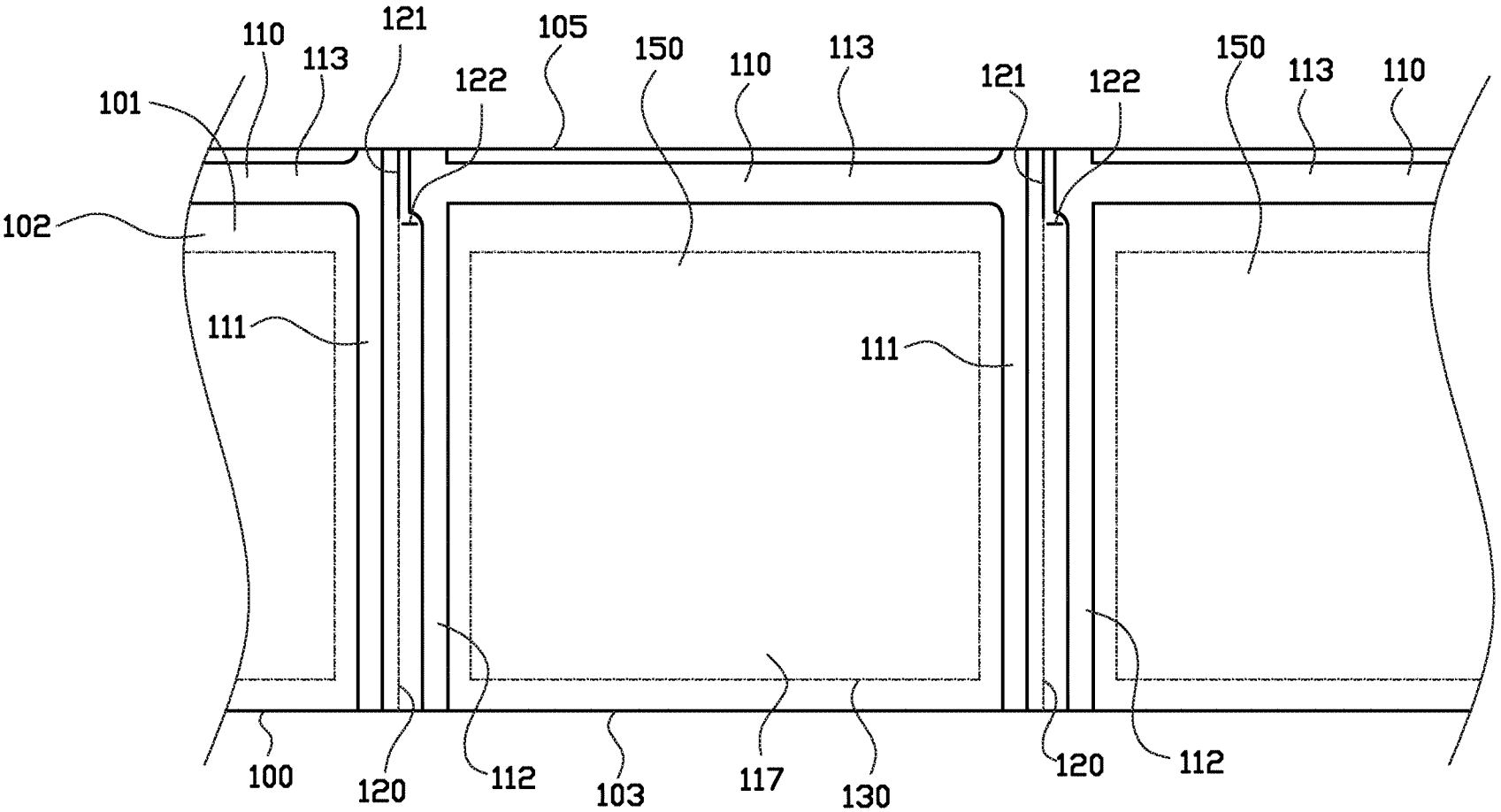
FIG. 3B is a close-up detailed portion of FIG. 3A.

FIGS. 3A and 3B show the elongated web 100 in its finished state in which it is at the end of the web trajectory 22 of FIG. 2. During the transport through the packaging device 20 in the transport direction T as shown in FIG. 2, the elongated web 100 is provided with subsequent heat sealings 110. As best shown in FIG. 3B, the heat sealings 110 comprise an elongated front heat seal 111, an elongated back heat seal 112 and an elongated top heat seal 113 between the front side 102 and the back side 104. The front heat seal 111 and the elongated back heat seal 112 extend parallel to each other and transverse to the bottom edge 103, and the top heat seal 113 extends there between and extends parallel and spaced apart from the top edges 105.

During the transport through the packaging device 20 the elongated web 100 is provided with subsequent straight separation perforation lines 120 between the heat sealings 110. The separation perforation lines 120 extend as from the bottom edge 103 over more than half of the distance between the bottom edge 103 and the top edges 105. In this example the separation perforation lines 120 extend over more than 70% of the distance between the bottom edge 103 and the top edges 105, though that could vary in other systems depending on the size, type of foil used, etc. Thereby foil bridges 121 are formed between the separation perforation lines 120 and the top edges 105.

During the transport through the packaging device 20 the elongated web 100 is provided with subsequent tear notches 122 that start at and extend transverse to the separation perforation lines 120. The tear notches 122 extend with respect to the bottom edge 103 at a height close to but below the top heat seal 113.

The elongated web 100 defines printable areas 117 on the front side 102 within the heat sealings 110. Behind the printable area 117 the elongated web 100 forms sealed off enclosures between the bottom edge 103 and the heat sealings 110 to contain and preserve the selection of discrete medicaments 10.

After transport through the packaging device 20 the elongated web 100 can be divided manually by tearing off the separation perforation lines 120, followed by tearing the foil bridges 121 to obtain a pouch 150 or a series of interconnected pouches 150. The separated pouches 150 can be opened manually by tearing off the top heat seal 113, which is initialized at the tear notch 122.

As shown in FIG. 2, the packaging device 20 comprises, in series, a printing station 30, a filling station 40, a sealing station 50, a perforation station 60 and an inspection station 70. The printing station 30 comprises a printer 31 that is configured to print text and symbols onto the printable areas 117 of the elongated web 100. The filling station 40 comprises a spreader 41 below the hopper outlet 8 that is configured to spread the front side 102 and the back side 104 of the elongated web 100 at the top edges 105 to receive the selection of discrete medicaments 10. The sealing station 50 comprises two L-shaped heat seal stamps 51 that are moveable or driven transverse to the elongated web 100 in direction A in a symmetric manner by means of a schematically shown stamp drive 52 to form the top heat seal 113 and the back heat seal 112 of one pouch 150, and to form the front heat seal 111 of the following pouch 150. The perforation station 60 comprises two perforation mechanisms, here shown as anvils 61 that are moveable or driven transverse to the elongated web 100 in direction B in a symmetric manner by means of a schematically shown anvil drive 62 to form the separation perforation line 120 and the tear notch 122 between two pouches 150. The inspection station 70 comprises an inspection camera 71 or an inspection sensor or an inspection (laser) photo sensor, or an ultrasonic inspection sensor or other sensing/detecting device for detecting faults in the elongated web 100. The faults are, for example, bad prints, errors in or absence of the heat sealings 110, separation perforation lines 120 or the tear notches 122.

As schematically shown in FIG. 1, the feeder device 1 and the packaging device 20 comprise a common electronic controller 80 that is connected with the feeder units 6, the position control motor 4, the hopper release valve, the web drive 23, the printer 31, the stamp drive 52, the anvil drive 62, the inspection camera 71 and the encoder 72. The electronic controller 80 comprises an electronic processor and a tangible, non-transitory memory for storing instructions, program code or software which, when executed by the processor, cause the controller 80 to control the actuation of these parts. In particular, the controller 80 is programmed to communicate with and/or form an electronic vision/inspection system together with the inspection camera 71 (or other sensor) to detect faults in the pouches 150 to be formed.

The electronic controller 80 is programmed to perform a normal processing method, a fault detection method and a small order processing method.

For performing the normal processing method as schematically shown in FIGS. 1 and 2, the electronic controller 80 is programmed to control the position control motor 4 of the feeder device 1 to repeatedly bring the collecting hopper 8 under particular feeder units 6, and to control these to release the discrete medicaments 10 to count out and compile a selection of discrete medicaments 10. The electronic controller 80 is programmed to control the web drive 23 for feeding the elongated web 100 in the packaging device 20 from the stock reel 119 and transport in the transport direction T. The electronic controller 80 is programmed to control the printer 31 to repeatedly print dedicated information on the printable areas 117 of the pouches 150 to be formed, for example the patient's name and the specification of the selection of discrete medicaments inside the pouch 150 to be formed. At the subsequent filling station 40 the selection of discrete medicaments 10 is fed between the spread front side 102 and back side 103, wherein the received selection of discrete medicaments matches with the dedicated information on the printable area 117.

The electronic controller 80 is programmed to control the heat seal stamps 51 at the subsequent sealing station 50. In the previous cycle the heat seal stamps 51 had already made the front heat seal 111. The electronic controller 80 is programmed to actuate the heat seal stamps 51 to move in direction A against the elongated web 100 and back to complete the entire heat sealing 110 and to form the front heat seal 111 of the next selection of discrete medicaments that is fed by the hopper outlet 8. The electronic controller 80 is programmed to control the actuation of the perforation anvils 61 to move in direction B against the elongated web 100 and back to form the separation perforation line 120 and the tear notch 122 to define the pouch 150 that contains the selection of discrete medicaments and with the matching dedicated information on the printable area 117. The electronic controller 80 is programmed to detect faults in the formed pouches 150, and in absence thereof to continue the process to form a long string of interconnected pouches 150. These can be subsequently handled either by a human operator or another machine or robot.

The electronic controller 80 is programmed to power the web drive 23 while monitoring the transport of the elongated web 100 by means of the encoder 72 so as to detect related errors for example a misalignment of the elongated web 100 with respect to the movement as imposed by the web drive 23.

The electronic controller 80 is programmed to respond to errors originating from other devices or modules of the feeder device 1, such as the feeder units 6, the position control motor 4 and the collection hopper 7, for example the hopper release valve.

Figure 4A:
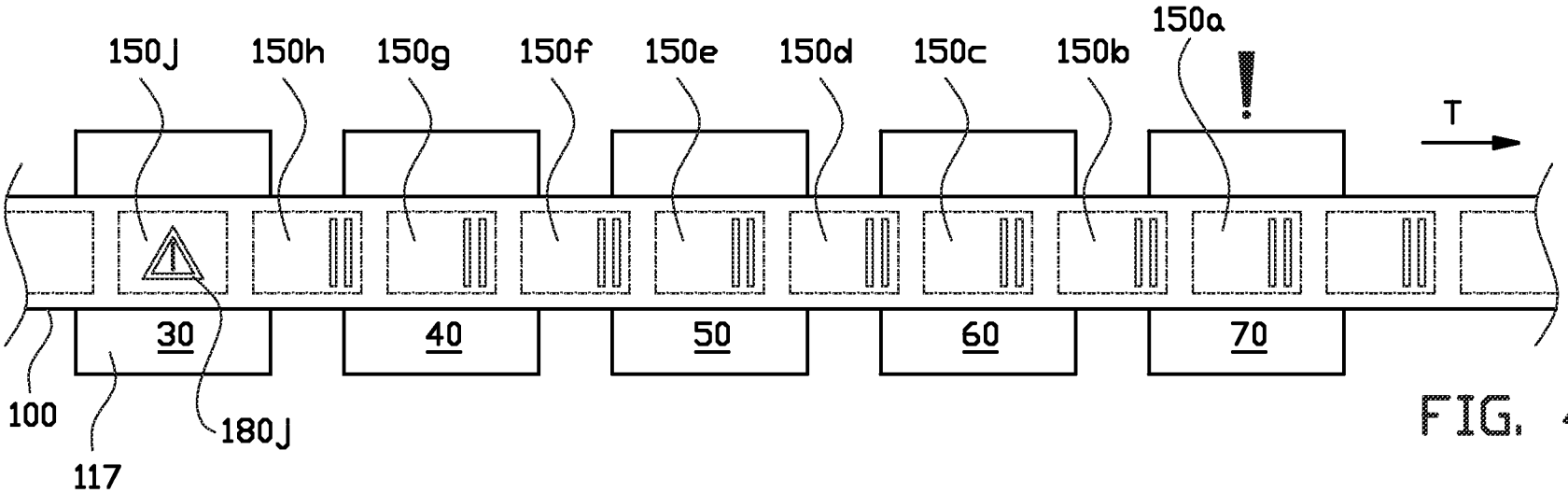
FIGS. 4A-4C illustrate a faulty pouch detection method as performed by the packaging device of FIGS. 1 and 2.
Figure 4B:
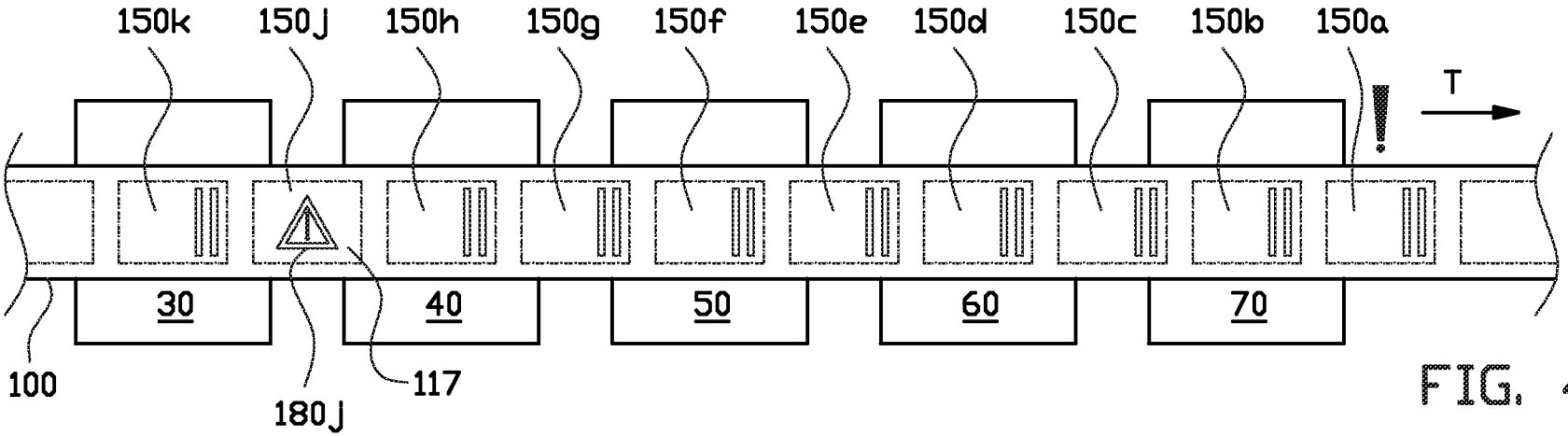
Figure 4C:
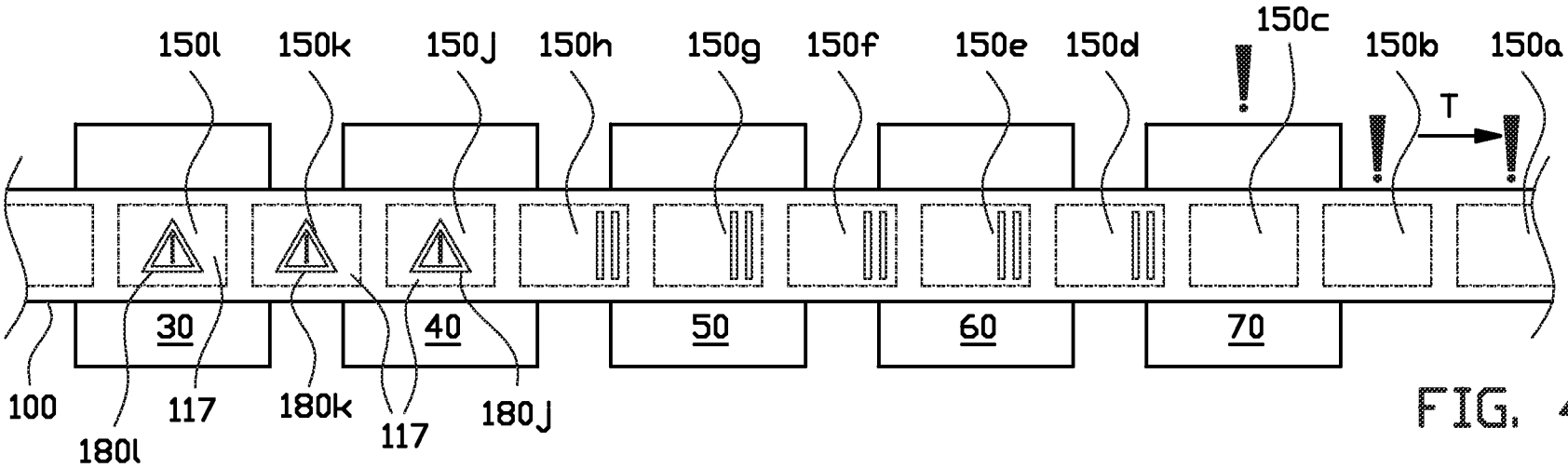

For performing the fault detection method as shown in FIGS. 4A-4C, the electronic controller 80 is programmed to detect faults in the formed pouches **150*a*-150*k* by means of the inspection camera 71 or the inspection sensor, or the inspection (laser) photo sensor, or the inspection laser photo sensor, or the ultrasonic inspection sensor or any other of the applied sensing/detecting device. As shown in FIG. 4A, in a first pouch 150*a* a fault is detected, for example a bad print in the printable area 117, an error in or absence of the heat sealing 110, an error in or absence of one of the separation perforation lines 120 between which the first pouch 150*a* is formed, and/or an error in or absence of the tear notch 122, and/or a misalignment of the elongated web 100 with respect to the movement as imposed by the web drive 23. The latter may for example be caused by an operator that has accidentally pulled on the end of the elongated web 100 whereby the printable area 117 becomes misaligned from filling station 40. The electronic controller 80 is programmed to control the printer 31 to print a fault symbol 180*j* on the printable area 117 of an upstream pouch 150*j* to be formed, in this example on the ninth pouch 150*j*. The electronic controller 80 is programmed to pause the feed of selections of discrete medicaments by the feeding device 1 whereby the ninth pouch 150*j* remains empty. The human operator that manually handles the string of interconnected pouches 150 is then visually warned that a human intervention is needed, in particular disposing off the bad first pouch 150*a*. In some embodiments, when the pouches are then handled robotically, such a fault symbol 180*j*** would also alert the machine or robot doing the subsequent handling to dispose of such a pouch.

As shown in FIG. 4B, the normal processing method is continued, or as shown in FIG. 4C, the fault detection and error symbol printing continues for a second pouch **150*b*, and for a third pouch 150*c*** when errors are detected.

Information of the error may be stored in the memory of the controller 80 and/or presented to the human or robotic operator to indicate which pouches 150 are affected. The operator may for example be notified of the number of pouches **150*b*-150*h* between the ninth pouch 150*j* and the faulty first pouch 150*a* and/or the number of pouches 150*a*-150*c*** that are affected.

Figure 5:
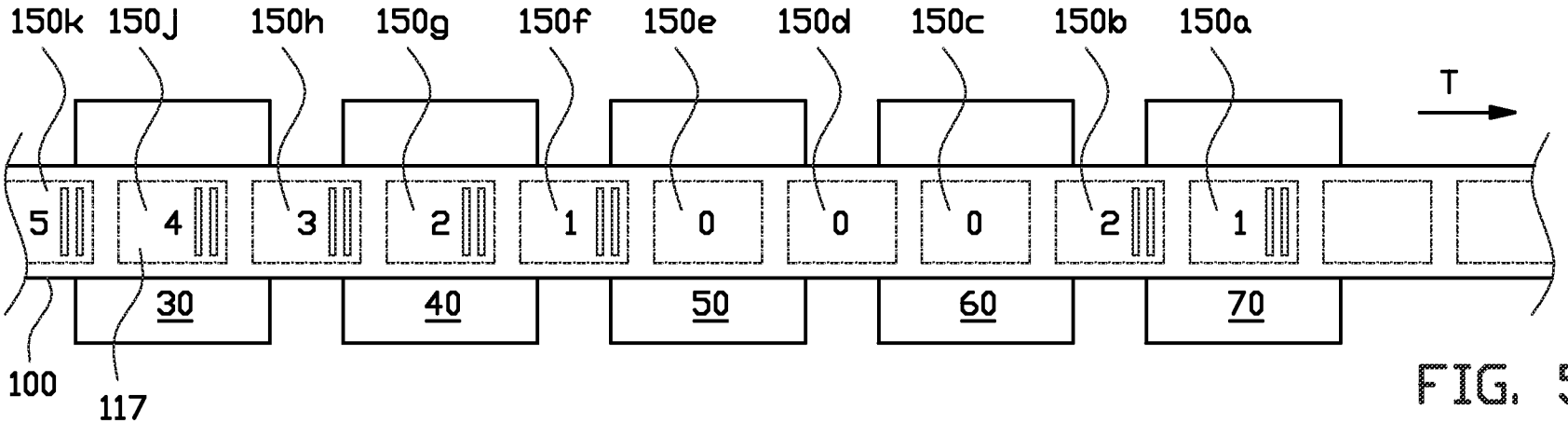
FIG. 5 shows a small order processing method as performed by the packaging device of FIGS. 1 and 2.

For performing the small order processing method as shown in FIG. 5, the electronic controller 80 is programmed to pause the printing by the printer 71 and the feed of medicaments by the feeder device 1 when the amount of pouches 150 per order is below a set minimal order value. In the shown example this minimal order value is five pouches 150. The electronic controller 80 is programmed to form the first order that comprises only a first pouch **150*a* and a second pouch 150*b* both containing their selection of discrete medicaments 10 and the matching dedicated information on the printable area 117, followed by an empty third pouch 150*c*, an empty fourth pouch 150*d* and an empty fifth pouch 150*e*. The empty pouches 150*c*, 150*d*, 150*e* may be unprinted or may receive an alternative marking that identifies said empty pouches 150*c*-150*e* as being empty or different from the filled pouches 150*a*, 150*b*. Thereafter a second order is formed, that contains five or more pouches 150*f*-150*k***.

The systems and methods according to aspects of the disclosed subject matter may also utilize a variety of special purpose computer and control systems, communications devices, networks and/or digital/logic devices for operation. Each may, in turn, be configurable to utilize a suitable computing/controller device that can be manufactured with, loaded with and/or fetch from some storage device, and then execute, instructions that cause the computing/controller device to perform a method according to aspects of the disclosed subject matter.

While the description refers to medicaments, tablets, etc., the devices and methods could be used for dispensing other types of solid discrete items for separation and packaging.

It is to be understood that the above description is included to illustrate the operation of the preferred embodiments and is not meant to limit the scope of the invention. From the above discussion, many variations will be apparent to one skilled in the art that would yet be encompassed by the spirit and scope of the present invention.

LIST OF REFERENCE NUMERALS

1 feeder device
2 frame
3 supporting disc
4 position control motor
5 radially extending arrays
6 feeder unit
7 collecting hopper
8 hopper outlet
9 arm
10 discrete medicaments
20 packaging device
22 web trajectory
23 web drive
30 printing station
31 printer
40 filling station
41 spreader
50 sealing station
51 seal stamp
52 stamp drive

60 perforation station
61 perforation anvil
62 anvil drive
70 inspection station
71 inspection camera
72 encoder
80 electronic controller
100 elongated web
101 foil
102 front side
103 bottom edge
104 back side
105 top edge
110 heat sealing
111 front heat seal
112 back heat seal
113 top heat seal
117 printing area
119 stock reel
120 separation perforation line
121 foil bridge
122 tear notch
150 pouch
180 fault symbol

The invention claimed is:

1. A method for packaging discrete medicaments in pouches in a packaging device configured to form and fill the pouches in an elongated web, the method comprising the following steps:

transporting the elongated web along a web trajectory, printing information on the elongated web related to the discrete medicaments that are fed to the elongated web at the position of the printed information on the elongated web, feeding the discrete medicaments to the elongated web at the position on the elongated web of the related printed information, inspecting the elongated web to determine whether there is a fault related to the elongated web, and in response to a fault being detected, printing a fault indication or a fault symbol on the elongated web, and forming an empty pouch at the position of the fault indication or fault symbol.

2. The method of claim 1, wherein the fault is a faulty pouch, and the printing of the fault indication or a fault symbol on the elongated web is performed upstream from the detected faulty pouch.

3. The method of claim 1, wherein the transporting of the elongated web along the web trajectory is done by means of a web drive.

4. The method of claim 1, wherein the printing information on the elongated web is done by means of a printer at a print station.

5. The method of claim 1, wherein the packaging device comprises a transport monitoring device for monitoring the transport of the elongated web along the web trajectory for the step of inspecting the elongated web to determine whether there is a fault related to an alignment of the elongated web.

6. The method of claim 1, wherein the packaging device comprises an inspection station along the web trajectory for the step of inspecting the elongated web to determine whether there is a fault related to the elongated web.

7. The method of claim 6, wherein the inspection station comprises one or more of an inspection camera, an inspection sensor, an inspection photo sensor, an inspection laser photo sensor, or an ultrasonic inspection sensor, and the inspecting comprises an inspection of the elongated web by said inspection camera, inspection sensor, inspection photo sensor, inspection laser photo sensor or an ultrasonic inspection sensor.

8. The method according to claim 1, and further comprising applying a heat sealing in the elongated web to enclose the medicaments that have been fed to the elongated web.

9. The method of claim 8, wherein the step of inspecting the elongated web to determine whether there is a fault related to the elongated web comprises sensing a faulty heat sealing.

10. The method of claim 1, and further comprising applying a separation perforation line in the elongated web between pouches to be formed, and wherein the step of inspecting the elongated web to determine whether there is a fault related to the elongated web comprises detecting a faulty separation perforation line.

11. The method of claim 1, and further comprising forming a tear notch, and wherein the step of inspecting the elongated web to determine whether there is a fault related to the elongated web comprises detecting a faulty tear notch.

12. The method of claim 1, wherein the elongated web comprises a foil that forms a front side and a back side between which the medicaments are received.

13. The method of claim 12, wherein the foil is folded back onto itself, whereby the front side continues into the back side via a fold that forms a bottom edge of the elongated web.

14. The method of claim 12, wherein the foil comprises a printable plastic.

15. The method of claim 1, wherein the step of printing a fault indication or a fault symbol on the elongated web comprises printing the fault indication or fault symbol on the elongated web upstream from the fault.

16. Computer program product having a non-transitory computer readable medium with instructions saved thereon that, when executed by a processor, cause a packaging device to perform the method according to claim 1.

17. A packaging device for packaging discrete medicaments in pouches, the packaging device comprising:

a web drive for transport of the elongated web in a transport direction over a web trajectory, a printing station for printing information on the elongated web, the information related to the discrete medicaments that are fed to the elongated web at the position of the printed information on the elongated web, and a filling station configured to feed the discrete medicaments to the elongated web in pouches formed in the elongated web, an inspection station for detecting a fault in the elongated web; and a controller configured to instruct the printing station to print a fault indication on the elongated web in response to a fault being detected in the elongated web, and to instruct the packaging device to form an empty pouch at the position of the fault indication.

18. The packaging device of claim 17, wherein the fault is one or more of: a faulty pouch, a faulty seal, a faulty separation perforation, a faulty tear notch and a misalignment of the elongated web with respect to one of the stations.

19. The packaging device of claim 17, wherein the inspection station comprises one or more of an inspection camera, an inspection sensor, an inspection photo sensor, an inspection laser photo sensor, or an ultrasonic inspection sensor.

20. The packaging device of claim 17, and further comprising a perforation station along the web trajectory to apply one or more separation perforation and/or tear lines in the elongated web.

21. The packaging device of claim 17, and further comprising a sealing station for sealing the pouches in the elongated web.

* * * * *